US012053713B2

(12) United States Patent
Williams et al.

(10) Patent No.: US 12,053,713 B2
(45) Date of Patent: Aug. 6, 2024

(54) FLUID FILLED SQUEEZE NOVELTY WITH PATTERNED FLOW CHANNELS

(71) Applicant: Plan C, LLC, Bend, OR (US)

(72) Inventors: Kevin Williams, Seabrook, SC (US); Steven Edward Walterscheid, Bend, OR (US)

(73) Assignee: Plan C, LLC, Bend, OR (US)

( * ) Notice: Subject to any disclaimer, the term of this patent is extended or adjusted under 35 U.S.C. 154(b) by 182 days.

(21) Appl. No.: 17/726,483

(22) Filed: Apr. 21, 2022

(65) Prior Publication Data

US 2023/0338868 A1 Oct. 26, 2023

(51) Int. Cl.

| | |
|---|---|
| ***A63H 33/00*** | (2006.01) |
| ***A63H 23/10*** | (2006.01) |
| ***A63H 33/22*** | (2006.01) |

(52) U.S. Cl.

CPC ..... *A63H 33/00* (2013.01); *A63H 23/10* (2013.01); *A63H 33/22* (2013.01)

(58) Field of Classification Search

CPC ..... A63H 23/00; A63H 23/10; A63H 33/22
See application file for complete search history.

(56) References Cited

U.S. PATENT DOCUMENTS

| | | | | |
|---|---|---|---|---|
| 2,919,135 A | | 12/1959 | Marchionda | |
| 3,172,223 A | * | 3/1965 | Stager | A01M 31/06 446/159 |
| 3,334,899 A | * | 8/1967 | Bosko | A63B 21/075 446/267 |
| 3,658,326 A | | 4/1972 | Fawick | |
| 4,040,619 A | | 8/1977 | Land | |
| 4,116,202 A | * | 9/1978 | Panicci | A61J 17/02 D24/194 |
| 4,142,715 A | | 3/1979 | Matsumoto | |
| 4,363,483 A | | 12/1982 | Minami | |
| 5,104,699 A | * | 4/1992 | Pantaleo | A63F 7/045 40/426 |
| 5,540,720 A | * | 7/1996 | Ortega | A63H 33/22 606/235 |
| 6,582,274 B1 | * | 6/2003 | Chernek | A63H 5/00 446/397 |
| 6,918,862 B1 | * | 7/2005 | Comeau | A63B 23/16 482/44 |
| 7,207,930 B2 | * | 4/2007 | Bonutti | A63B 23/1281 482/44 |
| 2013/0331000 A1 | | 12/2013 | Drozdowski | |

* cited by examiner

*Primary Examiner* — John A Ricci
(74) *Attorney, Agent, or Firm* — LaMorte & Associates P.C.

(57) ABSTRACT

A handheld novelty device that utilizes a bag structure having a first flexible plastic sheet and a second flexible plastic sheet. At least part of the bag structure is transparent so that the contents of the bag structure can be viewed. The first flexible plastic sheet is molded or bonded to the second flexible plastic sheet in selected areas. This defines a plurality of interconnected chambers in the bag structure. The interconnected chambers include a first chamber, a second chamber and a meandering pathway that interconnects the first chamber to the second chamber. Flow material is provided that at least partially fills the plurality of interconnected chambers. The flow material can be a liquid with floating solids, or a slurry of solids and liquids. The flow material is displaced within the plurality of interconnected chambers when at least one of the plurality of interconnected chambers is compressed.

15 Claims, 7 Drawing Sheets

FLUID FILLED SQUEEZE NOVELTY WITH PATTERNED FLOW CHANNELS

BACKGROUND OF THE INVENTION

1. Field of the Invention

In general, the present invention relates to fluid filled squeeze novelties where the fluid contents in a chamber are displaced when the chamber is squeezed. The present invention also relates to fluid filled squeeze novelties where the flow of fluid in the novelty becomes more prevalent while the novelty is being squeezed.

2. Prior Art Description

Fidget toys are a class of toys that are designed to entice a person to manually manipulate the toy. Fidget toys typically provide some visual and audible stimuli when manually manipulated and are sized to be readily carried in a pocket. Fidget toys are often used at times of anxiety or boredom. The sensory stimuli provided by a fidget toy has a calming effect and enhances the ability of some individuals to remain calm and attentive. There are many kinds of fidget toys in the marketplace. Many fidget toys are squeeze toys that contain a liquid fill. In the marketplace, such fidget toys are commonly marketed as stress balls. The toys elongate or bulge when squeezed. This provides good tactile, visual, and audible feedback to the individual squeezing the toy. Such fluid filled fidget toys are typically sized to fit in the palm of one hand. This enables the fidget toy to be easily carried in a pocket. As a consequence, the squeeze toy is often too small to be manipulated with both hands simultaneously. If an individual fidgets with two hands, the squeeze toy must be passed back and forth between hands.

There are some fluid filled products that are intended to be held and squeezed with two hands. However, such products are typically used to exercise the hands and improve grip strength. Such prior art is exemplified by U.S. Pat. No. 3,658,326 to Fawick, U.S. Pat. No. 4,040,619 to Landi and U.S. Pat. No. 2,919,135 to Marchionda. Such devices are not designed for sensor stimulus and do little more than provide resistance to squeezing. As a result, such prior art devices are ineffective as fidget toys and provide little play value.

There are other classes of toys that are fluid filled and are squeezed using one or two hands. This class of toys are water display toys. That is, the toys have a display tank with objects that float within the tank. Such toys typically have one or two pumps that are selectively squeezed by the user. The squeezing of a pump creates a jet of water within the display tank that acts to move the objects floating within the display tank. Such prior art is exemplified by U.S. Pat. No. 4,363,483 to Minami and U.S. Pat. No. 4,142,715 to Matsumoto. Water display toys, although interesting toys, are poorly suited as fidget toys. Water display toys typically have large and bulky display tanks. This makes the toys too large to be conveniently carried in a pocket. Furthermore, water display toys often depend upon gravity to orient the objects on display. The result is that the water display toys can only be played when placed upon a flat surface. Such water display toys cannot be tilted in the hands and manipulated under a desk as a person focuses their attention on another task. Lastly, water display toys are complicated to manufacture, which makes the toys relatively expensive as compared to other fidget toys.

A need therefore exists for a fluid filled fidget toy that is very inexpensive to manufacture, can be played using two hands, can be carried in a pocket, and can be played in any orientation. These needs are met by the present invention as described and claimed below.

SUMMARY OF THE INVENTION

The present invention is a handheld novelty device that utilizes a bag structure having a first flexible plastic sheet and a second flexible plastic sheet. At least part of the bag structure is transparent so that the contents of the bag structure can be viewed. The first flexible plastic sheet is molded or bonded to the second flexible plastic sheet in selected areas. This defines a plurality of interconnected chambers in the bag structure between the first flexible plastic sheet and the second flexible plastic sheet.

The interconnected chambers formed in the bag structure include a first chamber, a second chamber and a meandering pathway that interconnects the first chamber to the second chamber. A liquid, gel and/or slurry material is provided that at least partially fills the plurality of interconnected chambers. The material is displaced within the plurality of interconnected chambers when at least one of the plurality of interconnected chambers is compressed.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention novelty device can be embodied in many ways, only a few exemplary embodiments are illustrated. The exemplary embodiments are being shown for the purposes of explanation and description. The exemplary embodiments are selected in order to set forth some of the best modes contemplated for the invention. The illustrated embodiments, however, are merely exemplary and should not be considered limitations when interpreting the scope of the appended claims.

Figure 1:
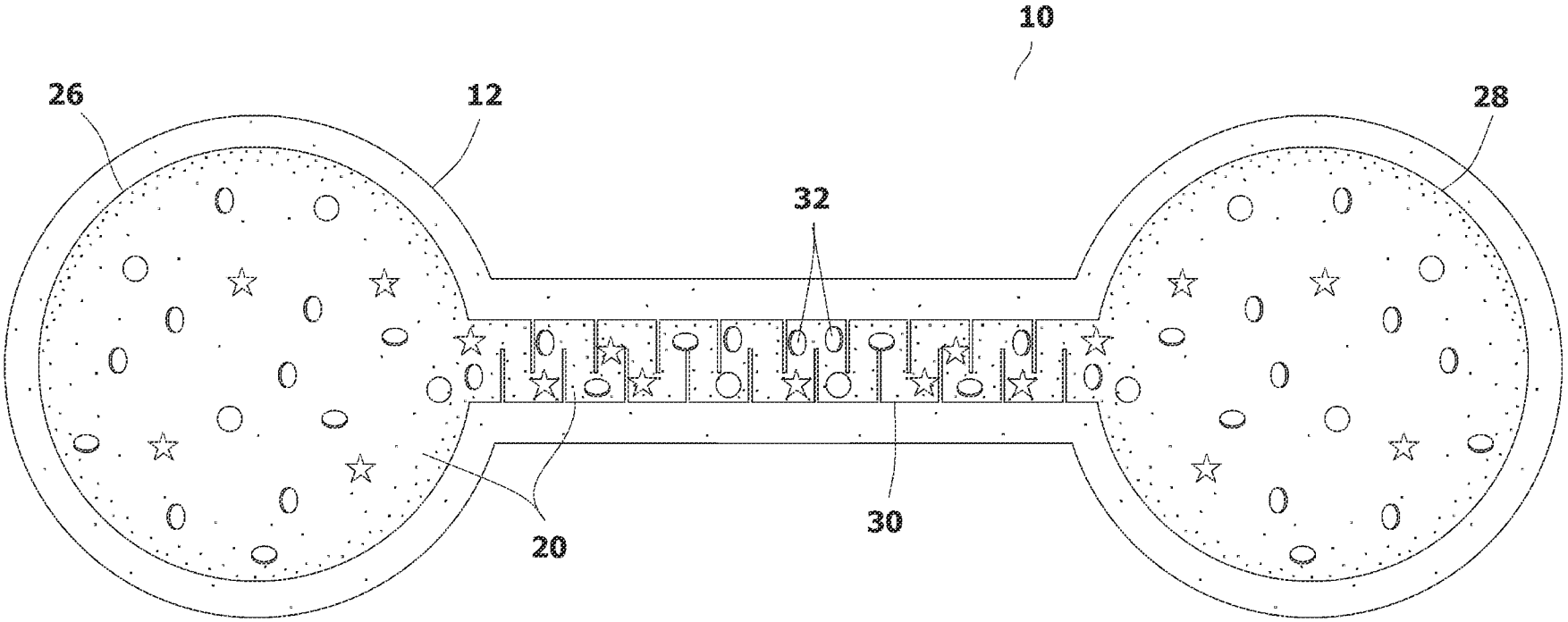
FIG. 1 shows a first exemplary embodiment of a fluid filled novelty in accordance with the present invention.
Figure 2:
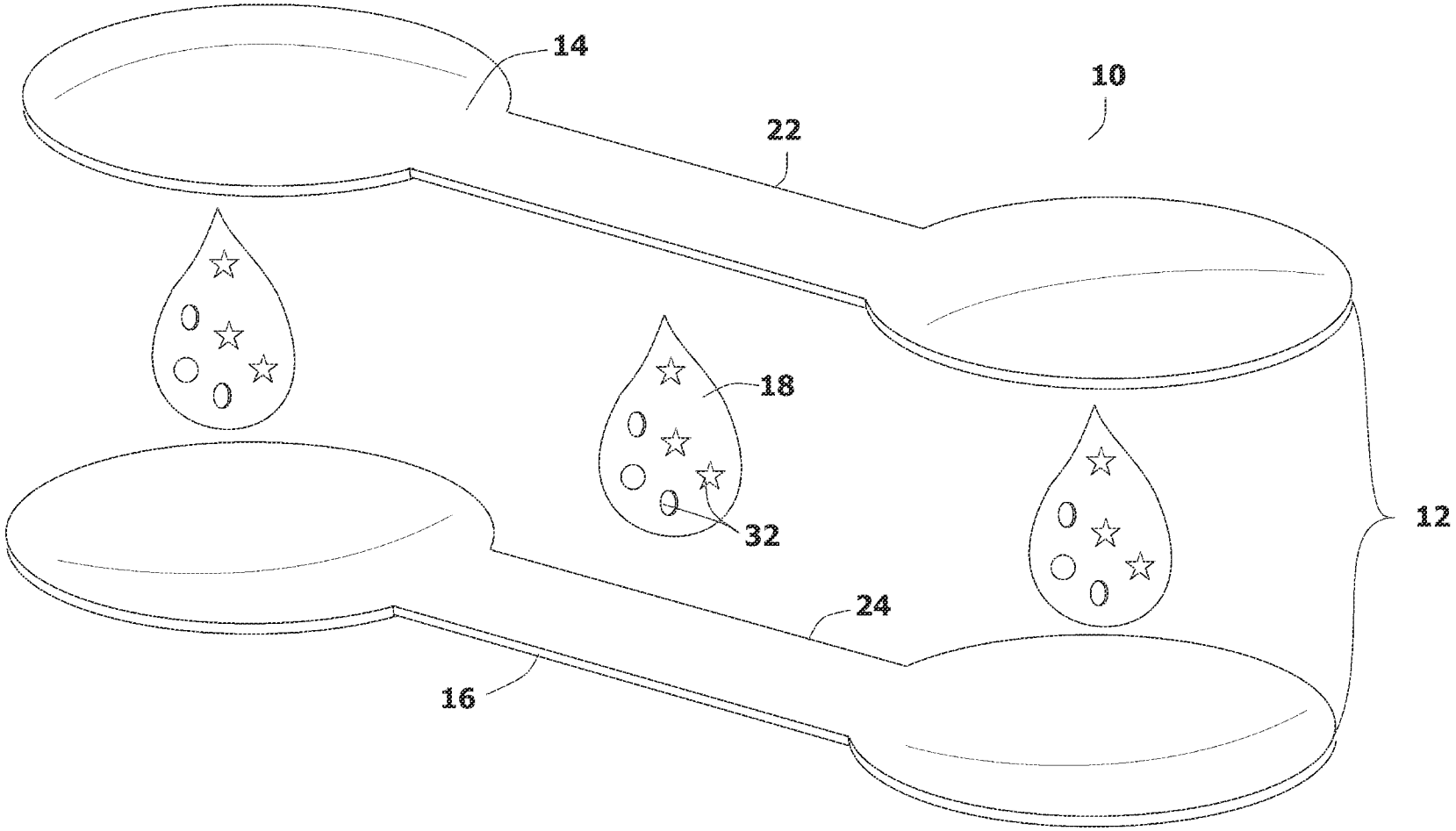
FIG. 2 is an exploded view of the exemplary embodiment of FIG. 1.

Referring to FIG. 1 in conjunction with FIG. 2, a novelty device 10 is shown. The novelty device 10 includes a fluid impervious bag structure 12. The bag structure 12 has a top first surface 14 and a bottom second surface 16. The top first surface 14 and the bottom second surface 16 are selectively bonded together to form a plurality of interconnected chambers 20 that are interposed between the top first surface 14 and the bottom second surface 16. The plurality of interconnected chambers 20 are sealed and are isolated between the top first surface 14 and the bottom second surface 16. A low viscosity fluid 18 is disposed within the plurality of interconnected chambers 20. As the novelty device 10 is squeezed, twisted, or otherwise compressed, the fluid 18 is displaced and travels through the plurality of interconnected chambers 20 away from the area of highest compression pressure.

The bag structure 12 of the novelty device 10 is either transparent or highly translucent. In this manner the fluid 18 retained by the bag structure 12 can be seen through the material of the bag structure 12. The bag structure 12 of the novelty device 10 can be made in different ways. For example, the bag structure 12 can be blow-molded or dip-molded as a single piece. However, in the shown embodiment, the top first surface 14 of the novelty device 10 is made from a first plastic sheet 22 and the bottom second surface 16 is made from a second plastic sheet 24. Both the first plastic sheet 22 and the second plastic sheet 24 are thin and highly flexible. The first plastic sheet 22 and the second plastic sheet 24 are bonded together around the peripheries of the plurality of interconnected chambers 20. The bonding can be creating using heat bonding or adhesive bonding. The first plastic sheet 22 and the second plastic sheet 24 are preferably thin and are incapable of supporting their own weight or the weight of the fluid 18. Accordingly, the novelty device 10 easily bends and twists when held in a user's hand. The ability to bend and twist adds valve to play, as is later explained.

The plurality of interconnected chambers 20 can be arranged in a wide variety of patterns. Regardless of the pattern selected, the plurality of interconnected chambers includes at least two primary chambers 26, 28 and at least one meandering pathway 30 that interconnects the two primary chambers 26, 28. In the shown embodiment, the two primary chambers 26, 28 are bulbous and are located at opposite ends of the bag structure 12. The meandering pathway 30 between the two primary chambers 26, 28 is complex and can follow a serpentine pattern and/or contain loops that make the flow pattern through the connecting pathway anything but straight.

The first primary chamber 26 has a first volume capacity. The second primary chamber 28 has a second volume capacity that is the same or close to that of the first primary chamber 26. The meandering pathway 30 has a preferred volume capacity that is less than that of either of the primary chambers 26, 28.

The volume of the low-viscosity fluid 18 is sealed within the plurality of interconnected chambers 20. However, the plurality of interconnected chambers 20 is not filled to capacity. Rather, the volume of fluid 18 used is sufficient to fully fill only one of the primary chambers 26, 28 and the meandering pathway 30. In this manner, one of the primary chambers 26, 28 can be compressed and emptied without pressurizing the remaining primary chamber 26, 28 and the meandering pathway 30 to a point of bursting.

The low-viscosity fluid 18 can be any non-toxic fluid that does not act to dissolve the material selected for the bag structure 12. Water, aqueous gels and/or edible oils are preferred fluids. The fluid 18 can be artificially colored to make the fluid 18 more visible within the bag structure 12. Small secondary objects 32, such as glitter, molded color beads, or the like can be mixed into the low-viscosity fluid 18. The secondary objects 32 are small enough and light enough to be moved by the flow of the fluid 18 in the meandering pathway 30. The presence of the secondary objects 32 makes the fluid 18 more visible and makes the movement of the fluid 18 more visible. Alternatively, the secondary objects 32 can be present in a high concentration relative to the fluid 18, wherein the fluid 18 serves as a lubricant to the secondary objects 32. The fluid 18 and secondary objects 32 therein, form a viscous slurry that can flow through the meandering pathway 30.

Figure 3:
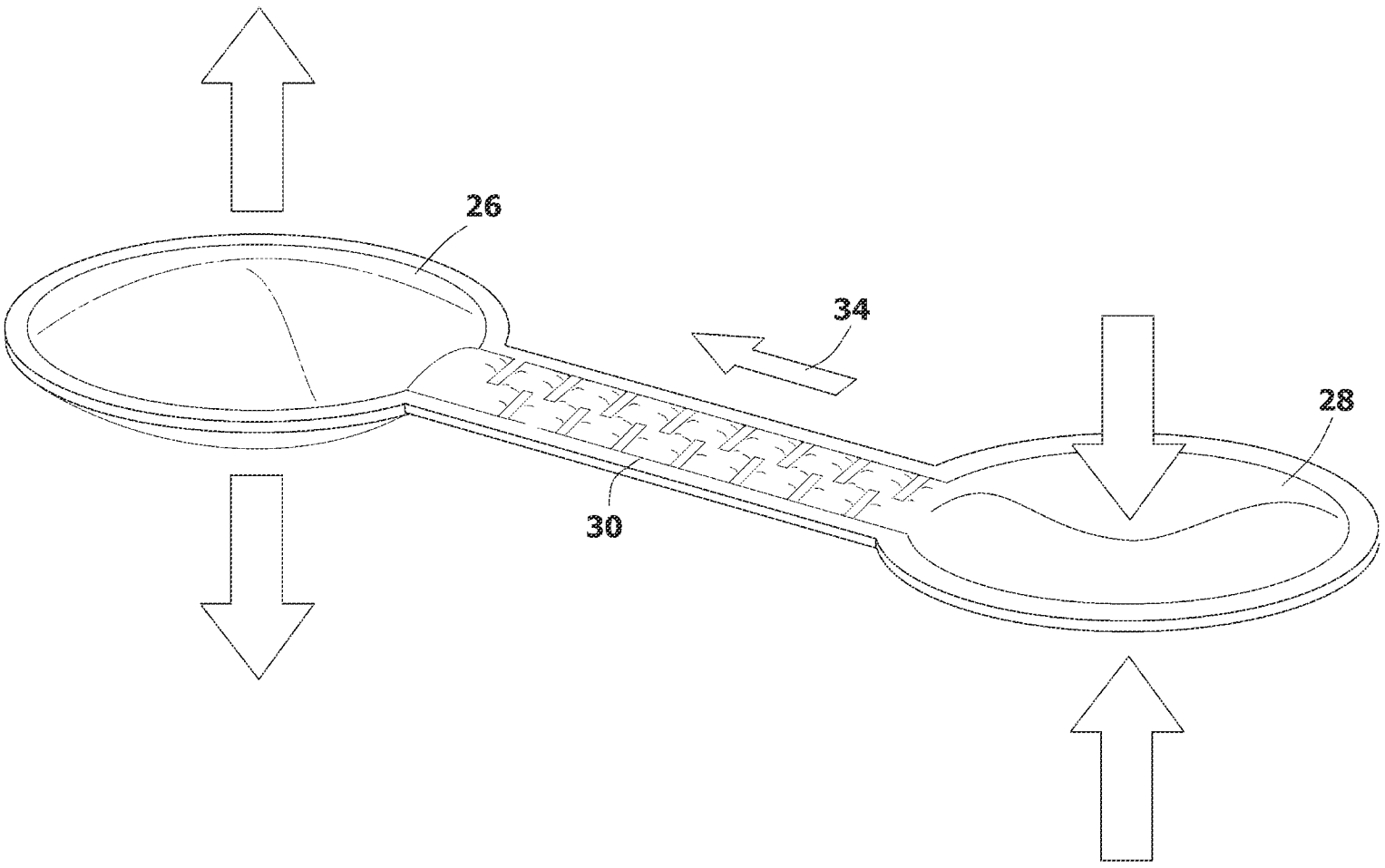
FIG. 3 is a perspective view of the exemplary embodiment of FIG. 1, showing a primary chamber on the left side of the illustration being compressed.
Figure 4:
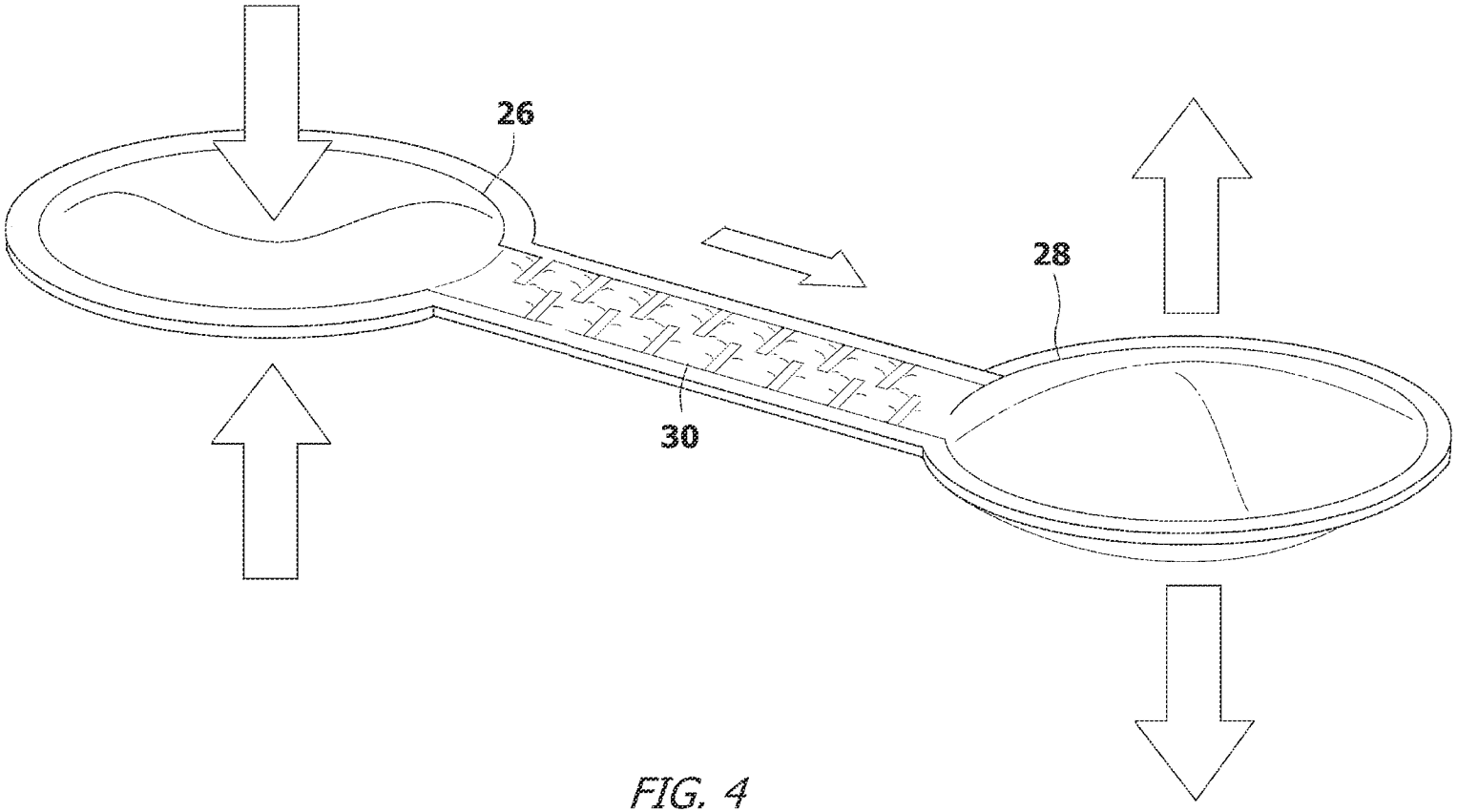
FIG. 4 is a perspective view of the exemplary embodiment of FIG. 1, showing a primary chamber on the right side of the illustration being compressed.

Referring to FIG. 3 and FIG. 4 in conjunction with FIG. 1 and FIG. 2, it will be understood that when the first primary chamber 26 is compressed, the low viscosity fluid 18 within the first primary chamber 26 is displaced. The fluid 18 flows through the meandering pathway 30 and in the direction of arrow 34. The fluid 18 increases the pressure within the meandering pathway 30 and fully expands the meandering pathway 30. The dilation of the meandering pathway 30 makes it easier for the secondary objects 32 in the fluid 18 to move through the meandering pathway 30. When the compression force is removed, the meandering pathway 30 experiences less pressure and partially collapses, therein causing the secondary solids 32 in the fluid 18 to remain generally stationary. Conversely, when the opposite second primary chamber 28 is compressed, the fluid pressure within the meandering pathway 30 again increases and the meandering pathway 30 expands to its maximum. Within the meandering pathway 30, the fluid 18 and secondary objects 32 move in the opposite directions, refilling the first primary chamber 26. This process can be rapidly repeated, therein causing the fluid 18 to rapidly flow back and forth through the meandering pathway 30.

Figure 5:
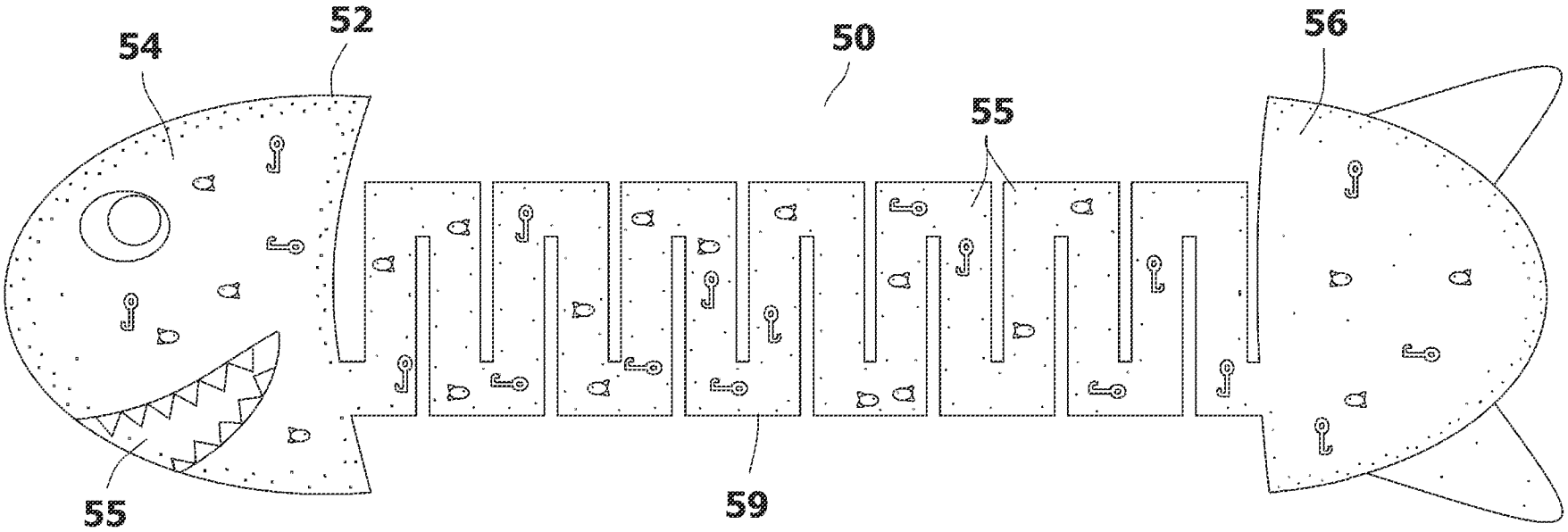
FIG. 5 shows a second exemplary embodiment of a fluid filled novelty in accordance with the present invention.

Referring to FIG. 5, it will be understood that a novelty device 50 can have a bag structure 52 that is custom shaped into a decorative pattern. Furthermore, all of the areas of the bag structure 52 that are not required to maintain the integrity of the internal interconnected chambers cam be removed. Furthermore, the bag structure 52 can have printed graphics 55 to enhance a selected decorative pattern. In the shown embodiment, the bag structure 52 is shaped as a fish with two primary chambers 54, 56 positioned in the head and the tail of the fish. A meandering pathway 58 connects the primary chambers 54, 56 and follows a serpentine pattern through the body of the fish. In the shown embodiment, the serpentine pattern is a series of right angle turns 55. The right angle turns 55 slightly impede fluid flow and slow the flow of within the meandering pathway 59 to make the flow more interesting to observe.

Figure 6:
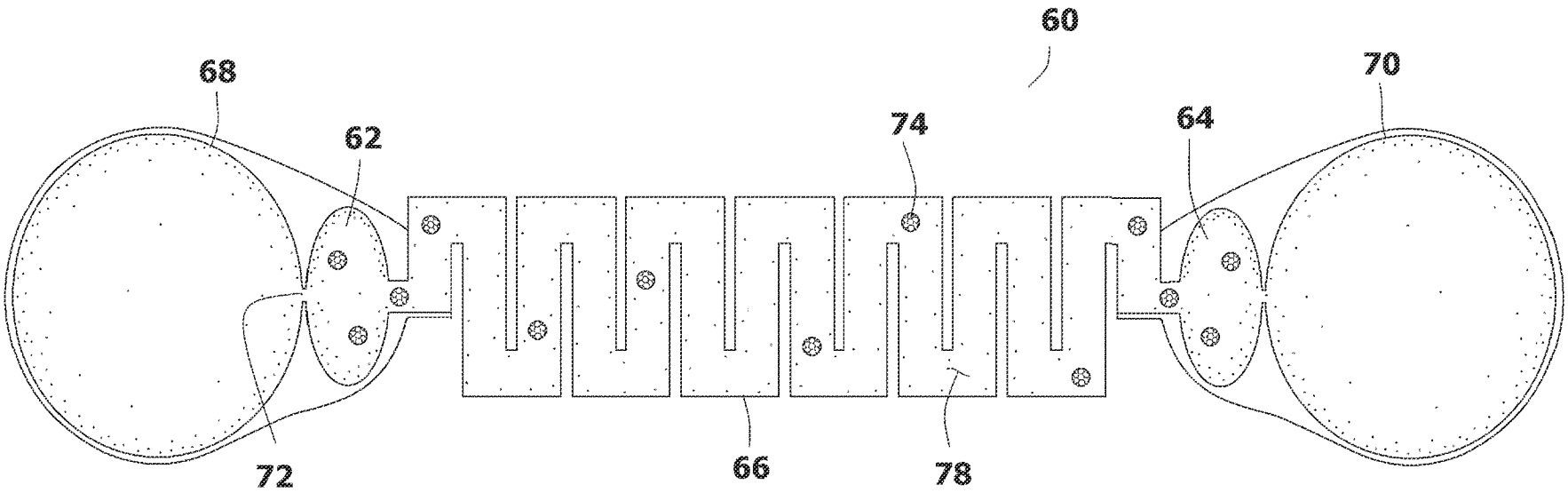
FIG. 6 shows a third exemplary embodiment of a fluid filled novelty in accordance with the present invention.

Referring to FIG. 6, it will be further understood that a novelty device 60, in accordance with the present invention, can be utilized as a game, in addition to being a fidget toy. In the game version of the novelty device 60, goal areas 62, 64 are provided at opposite ends of a meandering pathway 66. The goal areas 62, 64 are interposed between two primary chambers 68, 70 and the meandering pathway 66. The meandering pathway 66 has an average opening size. There are secondary openings 72 between the primary chambers 68, 70 and the goal areas 62, 64. The secondary openings 72 are smaller in size than the average opening size of the meandering pathway 66. At least one secondary object 74 is provided that is small enough to pass through the meandering pathway 66 but is too large to pass into the primary chambers 68, 70 though the secondary openings 72. In the shown embodiment, the secondary objects 74 appear as small soccer balls.

During play, one or more people grasps the novelty device 60 and selectively squeeze the primary chambers 68, 70. The structure of the novelty device 60 is floppy. As a result, when the novelty device 60 is grasped, it will bend and twist from the grasping forces and by the pull of gravity. Slight bends and twists of the novelty device 60 create bends and twists in the meandering pathway 66. These bends and twists often inhibit flow of the fluid 78 within the meandering pathway 66 more in one direction than in the opposite direction. As a consequence, with a certain configuration of bends and twists, the fluid 78 moves faster in one direction than in the other.

The person or persons holding the novelty device 60 alternately compresses the primary chambers 68, 70. The alternate compression of the primary chambers 68, 70 causes fluid 78 to flow back and forth in the meandering pathway 66 between goal areas 62, 64. The secondary objects 74 (soccer balls) move with the flow. The manipulations of the overall novelty device 60 alters the flow in the meandering pathway 66. The result is that a person can cause the secondary objects 74 to move more in one direction than another, even with equal compressions of the primary chambers 68, 70. In this manner, a person can play a game by trying to get the secondary objects 74 into one of the two goal areas 62, 64.

Figure 7:
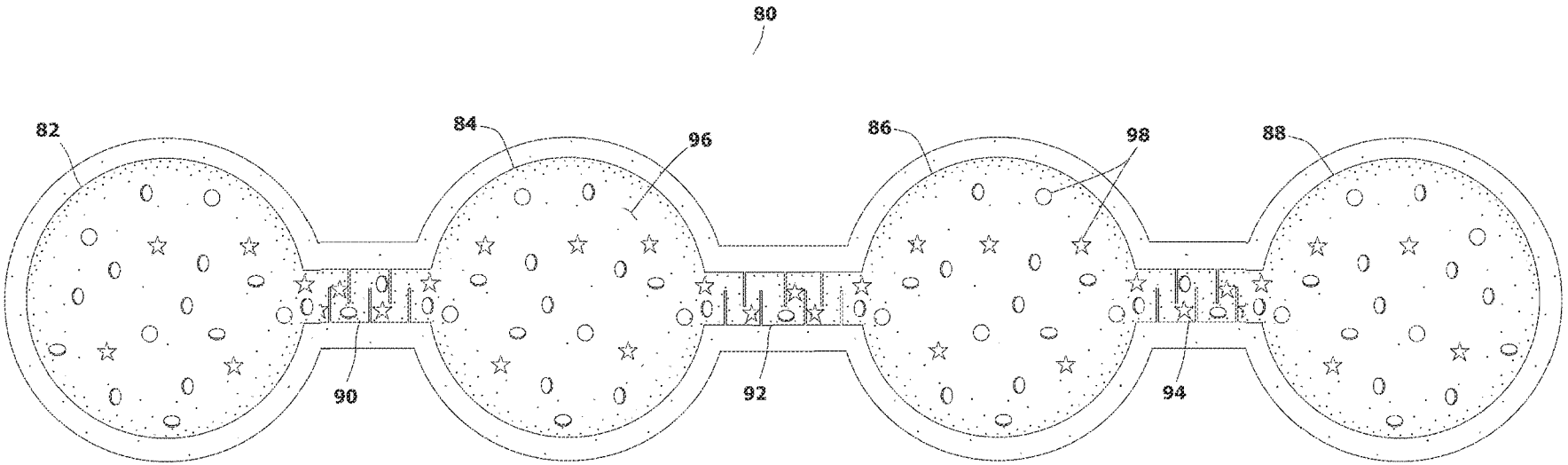
FIG. 7 shows a fourth exemplary embodiment of a fluid filled novelty in accordance with the present invention.

Referring to FIG. 7, it will be further understood that a novelty device 80, can have more than two primary chambers for use in playing a game. The use of multiple primary chambers allow two or more players to engage the novelty device 80 at the same time during play.

In the shown embodiment, the novelty devices 80 has four primary chambers 82, 84, 86, 88. The four primary chambers 82, 84, 86, 88 are linearly aligned and are interconnected by three segments of meandering pathway 90, 92, 94. The four primary chambers 82, 84, 86, 88 are hydraulically interconnected by the segments of meandering pathway 90, 92, 94. The novelty device 80 holds fill material 96 in the form of a liquid, gel or slurry. Various secondary objects 98 are dispersed within the fill material 96. The fill material 96 and the secondary objects 98 can be moved back and forth within the novelty device 80 by compressing the four primary chambers 82, 84, 86, 88 at different times with different degrees of force.

It will be understood that the embodiments of the present invention that are illustrated and described are merely exemplary and that a person skilled in the art can make many variations to those embodiments. For instance, the novelty device can be manufactured into many shapes, other than the shapes illustrated. Likewise, many different games can be played where the object of the game is to selectively move objects through the meandering pathway. All such embodiments are intended to be included within the scope of the present invention as defined by the claims.

What is claimed is:

1. A handheld novelty device, comprising:

a first flexible plastic sheet, wherein said first flexible plastic sheet is transparent;

a second flexible plastic sheet, wherein said second flexible plastic sheet is bonded to said first flexible plastic sheet in selected areas to define and isolate a plurality of interconnected chambers between said first flexible plastic sheet and said second flexible plastic sheet;

wherein said plurality of interconnected chambers include a first chamber, a second chamber and a meandering pathway that interconnects said first chamber to said second chamber, wherein said meandering pathway includes a serpentine pattern containing a series of right angle turns; and fluid at least partially filling said plurality of interconnected chambers, wherein said fluid is displaced within said plurality of interconnected chambers when at least one of said plurality of interconnected chambers is compressed, wherein said serpentine pattern impedes flow through said meandering pathway.

2. The novelty device according to claim 1, further including at least one solid secondary object disposed within said plurality of interconnected chambers, wherein said at least one secondary object is capable of being moved through said meandering pathway by said fluid.

3. The novelty device according to claim 1, further including secondary objects mixed with said fluid to form a slurry, wherein said slurry is capable of being moved through said meandering pathway by a pressure differential between said first chamber and said second chamber.

4. The novelty device according to claim 1, wherein said second flexible plastic sheet is transparent.

5. The novelty device according to claim 1, wherein said first chamber and said meandering pathway have a combined volume, wherein said fluid is present in said plurality of interconnected chambers in a volume no greater than said combined volume.

6. The novelty device according to claim 1, wherein said first flexible plastic sheet and said second flexible plastic sheet bend and twist under the weight of said fluid when unevenly supported.

7. A handheld novelty device, comprising:

a flexible bag structure having a top surface and a bottom surface, wherein said bag structure defines and isolates a plurality of interconnected chambers between said top surface and said bottom surface;

wherein said plurality of interconnected chambers includes a first large chamber separated from a second large chamber, wherein a narrow meandering pathway interconnects said first large chamber and said second large chamber, and wherein said meandering pathway includes a serpentine pattern containing a series of right angle turns; and viscous material partially filling said plurality of interconnected chambers, wherein said viscous material is displaced through said narrow meandering pathway when either said first large chamber or said second large chamber is compressed, wherein said serpentine pattern impedes flow through said meandering pathway.

8. The novelty device according to claim 7, wherein said viscous material includes secondary objects mixed with a fluid.

9. The novelty device according to claim 7, wherein said viscous material is a slurry of secondary objects mixed with a lubricating fluid, wherein said slurry is capable of being moved through said meandering pathway by a pressure differential between said first large chamber and said second large chamber.

10. The novelty device according to claim 7, wherein said bag structure is transparent.

11. The novelty device according to claim 7, wherein said first large chamber and said meandering pathway have a combined volume, wherein said viscous material is present in said plurality of interconnected chambers in a volume no greater than said combined volume.

12. The novelty device according to claim 7, wherein said bag structure bends and twists under the weight of said viscous material when unevenly supported.

13. A handheld novelty device comprising:

a transparent bag structure having a first compressible chamber and a second compressible chamber, wherein said first compressible chamber and said second compressible chamber are interconnected only by a meandering pathway, wherein said meandering pathway includes a serpentine pattern containing a series of right angle turns;

a viscous slurry disposed within said first compressible chamber, said second compressible chamber and said meandering pathway, wherein said viscous slurry is displaced through said meandering pathway and into said second compressible chamber when said first compressible chamber is compressed, and wherein said viscous slurry is displaced through said meandering pathway and into said first compressible chamber when said second compressible chamber is compressed and, wherein said serpentine pattern impedes flow through said meandering pathway.

14. The novelty device according to claim 13, wherein said viscous slurry contains secondary objects mixed with a lubricating fluid, wherein said viscous slurry is capable of being moved through said meandering pathway by a pressure differential between said first compressible chamber and said second compressible chamber.

15. The novelty device according to claim 13, wherein said bag structure bends and twists under the weight of said viscous slurry when unevenly supported.

* * * * *